US006751429B1

(12) United States Patent
Wing

(10) Patent No.: US 6,751,429 B1
(45) Date of Patent: Jun. 15, 2004

(54) COMPLIANT BACKER BAR

(75) Inventor: Joseph M. Wing, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 18 days.

(21) Appl. No.: 10/320,814

(22) Filed: Dec. 16, 2002

(51) Int. Cl.[7] ..... G03G 15/00
(52) U.S. Cl. ..... 399/164
(58) Field of Search ..... 399/164, 265, 399/266

(56) References Cited

U.S. PATENT DOCUMENTS 4,398,496 A * 8/1983 Kopko ..... 399/164
4,537,494 A * 8/1985 Lubinsky et al. ..... 399/164
4,769,671 A * 9/1988 Koff ..... 399/164
4,806,991 A 2/1989 Guslits ..... 355/3 DD
5,032,872 A * 7/1991 Folkins et al. ..... 399/266
5,168,318 A 12/1992 Haneda et al. ..... 355/326
5,600,418 A * 2/1997 Hart et al. ..... 399/285
5,669,049 A * 9/1997 Palumbo et al. ..... 399/265
5,953,565 A 9/1999 Fiore et al. ..... 399/164
6,032,014 A * 2/2000 Janssens et al. ..... 399/164
6,035,161 A 3/2000 Fiore et al. ..... 399/164
6,430,387 B1 * 8/2002 Quesnel et al. ..... 399/345

* cited by examiner

*Primary Examiner*—Fred Braun
(74) *Attorney, Agent, or Firm*—Joseph M. Young

(57) ABSTRACT

A backer bar assembly for supporting a photoreceptor belt, including a substantially rigid first backer bar having first and second ends and a second developer backer bar having first and second ends. The first and second ends of the first backer bar are substantially fixed, the first end of the lower developer backer bar is substantially fixed, and the second end of the lower developer backer bar is free to travel a short distance in response to an externally applied force.

20 Claims, 8 Drawing Sheets

COMPLIANT BACKER BAR

Generally, the process of electrophotographic printing includes charging a photoconductive member to a substantially uniform potential to sensitize the surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One color electrophotographic marking process, called image-on-image (IOI) processing, superimposes toner powder images of different color toners onto the photoreceptor before the transfer of the composite toner powder image onto the substrate. While the IOI process provides certain benefits, such as a compact architecture, there are several challenges to its successful implementation. For instance, the viability of printing system concepts, such as IOI processing, requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or noninteractive development systems.

Hybrid scavengeless development technology develops toner via a conventional magnetic brush onto the surface of a donor roll and a plurality of electrode wires are closely spaced from the toned donor roll in the development zone. An AC voltage is applied to the wires to generate a toner cloud in the development zone. This donor roll generally consists of a conductive core covered with a thin (50–200 $\mu$m) partially conductive layer. The magnetic brush roll is held at an electrical potential difference relative to the donor core to produce the field necessary for toner development. The toner layer on the donor roll is then disturbed by electric fields from a wire or set of wires to produce and sustain an agitaied cloud of toner particles. Typical AC voltages of the wires relative to the donor are 700–900 Volts peak to peak at frequencies of 5–15 kHz. These AC signals are often square waves, rather than pure sinusoidal waves. Toner from the cloud is then developed onto the nearby photoreceptor by fields created by a latent image.

Maintaining the proper distance between the developer units and the photoreceptor is an important task. The developer rolls must be in close enough proximity to the belt so that toner particles leave the roll and adhere to the belt and at the same time, cannot contact the belt and thereby disrupt toner already placed upon the belt.

Embodiments include a backer bar assembly for supporting a photoreceptor belt, including a substantially rigid first backer bar having first and second ends and a second developer backer bar having first and second ends. The first and second ends of the first backer bar are substantially fixed, the first end of the lower developer backer bar is substantially fixed, and the second end of the lower developer backer bar is free to travel a short distance in response to an externally applied force.

The embodiments will be described in detail herein with reference to the following figures in which like reference numerals denote like elements and wherein.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

Figure 1:
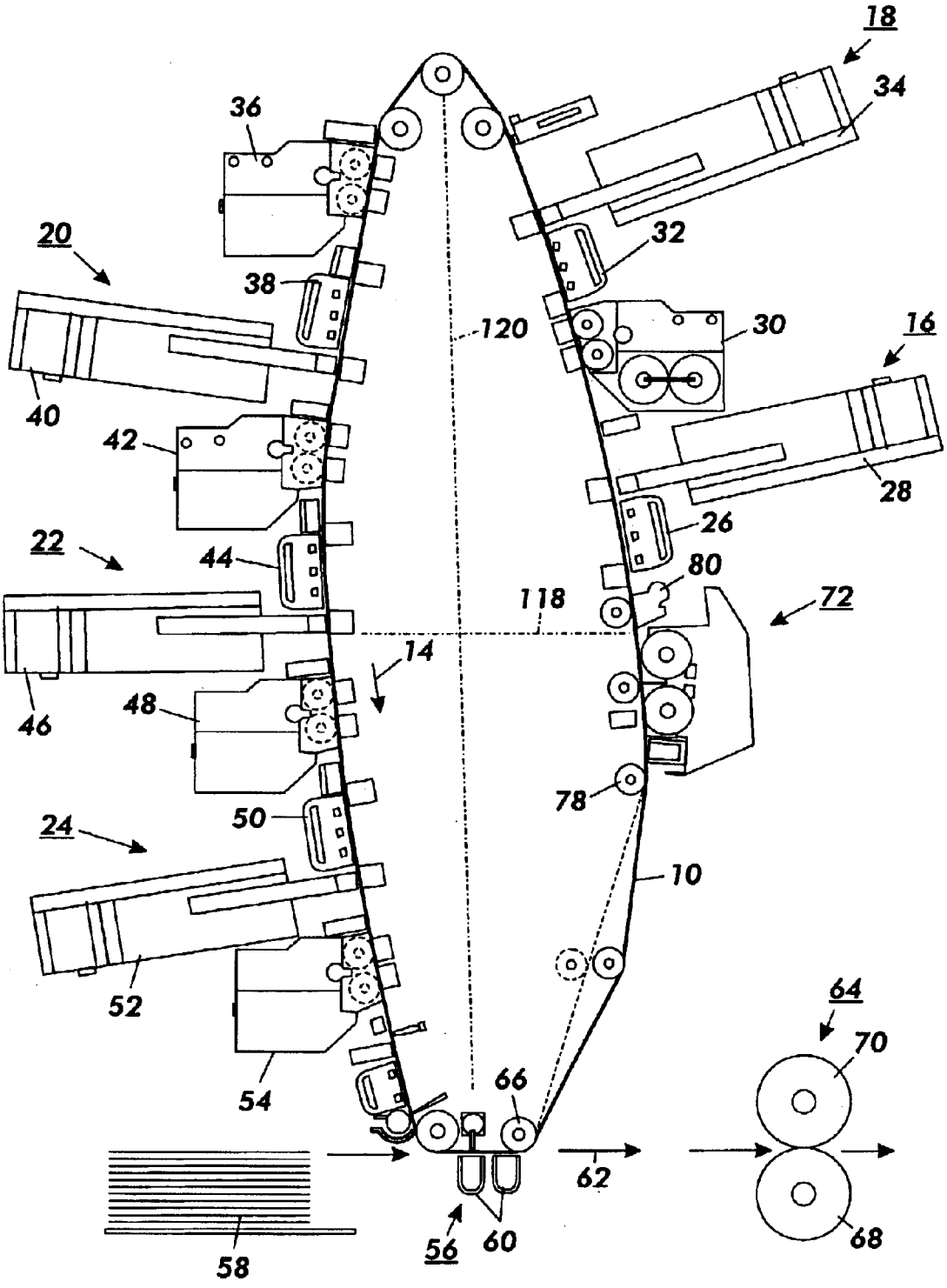
FIG. 1 is a schematic diagram showing an exemplary embodiment of a printing apparatus.

Referring now to FIG. 1, there is shown a single pass multi-color printing machine. This printing machine employs a photoconductive belt 10, supported by a plurality of rollers and backer bars, photoconductive belt 10 advances in the direction of arrow 14 to move successive portions of the external surface of photoconductive belt 10 sequentially beneath the various processing stations disposed about the path of movement thereof. In embodiments, the photoconductive belt 10 travels in a substantially elliptical path. In FIG. 1, the photoconductive belt is shown with major axis 120 and minor axis 118. In embodiments, the printing machine architecture includes five image recording stations indicated generally by the reference numerals 16, 18, 20, 22, and 24, respectively. In embodiments, photoconductive belt 10 initially passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

In embodiments, developer unit 30 develops this first electrostatic latent image. Developer unit 30 deposits toner particles of a selected color on the first electrostatic latent image. The first image recording station 16 and developer unit 30 are typically used for special colors, such as ones that may be used a lot (for example, as part of someone's trademark) or that just may be difficult to fabricate from standard mixing (for example, fluorescent orange). After the highlight toner image has been developed on the exterior surface of photoconductive belt 10, belt 10 continues to advance in the direction of arrow 14 to image recording station 18.

Image recording station 18 includes a recharging device and an exposure device. The charging device includes a corona generator 32, which recharges the exterior surface of photoconductive belt 10 to a relatively high, substantially uniform potential. The exposure device includes a ROS 34 that illuminates the charged portion of the exterior surface of photoconductive belt 10 selectively to record a second electrostatic latent image thereon. In embodiments, this second electrostatic latent image corresponds to the regions to be developed with magenta toner particles. This second electrostatic latent image is now advanced to the next successive developer unit 36.

In embodiments, developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40, which illuminates the charged portion of the exterior surface of photoconductive belt 10 to selectively dissipate the charge thereon to record a third electrostatic latent image, which, in embodiments, corresponds to the regions to be developed with yellow toner particles. This third electrostatic latent image is now advanced to the next successive developer unit 42.

In embodiments, developer unit 42 deposits yellow toner particles on the exterior surface of photoconductive belt 10 to form a yellow toner powder image thereon. These toner particles may be partially in superimposed registration with the previously formed magenta powder image. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image. In embodiments, the fourth latent image is developed with cyan toner particles. After the fourth electrostatic latent image is recorded on the exterior surface of photoconductive belt 10, photoconductive belt advances this electrostatic latent image to the cyan developer unit 48.

In embodiments, the cyan developer unit 48 deposits cyan toner particles on the fourth electrostatic latent image. These toner particles may be partially in superimposed registration with the previously formed yellow or magenta toner powder images. After the cyan toner powder image is formed on the exterior surface of photoconductive belt 10, photoconductive belt 10 advances to the next image recording station 24.

Image recording station 24 includes a charging device and an exposure device. The charging device includes corona generator 50, which charges the exterior surface of photoconductive belt 10 to a relatively high, substantially uniform potential. The exposure device includes ROS 52, which, in embodiments, illuminates the charged portion of the exterior surface of photoconductive belt 10 to selectively discharge those portions of the charged exterior surface of photoconductive belt 10 that are to be developed with black toner particles. The fifth electrostatic latent image, to be developed with black toner particles, is advanced to black developer unit 54.

In embodiments, the black developer unit 54, deposits black toner particles on the exterior surface of photoconductive belt 10. These black toner particles form a black toner powder image that may be partially or totally in superimposed registration with the previously formed yellow, magenta, and cyan toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. In embodiments, a vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets that may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78, which isolates the cleaning operation at cleaning station 72. At cleaning station 72, the residual toner particles are removed from photoconductive belt 10. Photoconductive belt 10 then moves under spots blade 80 to also remove toner particles therefrom.

The foregoing was a description of an exemplary embodiment of a machine in which the present invention may be used.

As can be scene in FIG. 1, each developer unit includes two donor rolls for transferring toner to the surface of the photoreceptor belt. Two backer bars can also be scene in FIG. 1. These hold the photoreceptor in position relative to the donor rolls. Because of the method of transfer, the donor rolls do not contact the surface of the photoreceptor so as not to destroy any previously laid toner powder images. The gap between the developer donor roll and the photoreceptor belt is an important parameter and is difficult to achieve and maintain. If the two are too close, previously deposited toner powder images can be destroyed, and if they are too far apart the toner will not transfer from the roll to the belt. Even with careful tolerance management of the piece parts, it is difficult to maintain a precisely constant separation distance.

Figure 2:
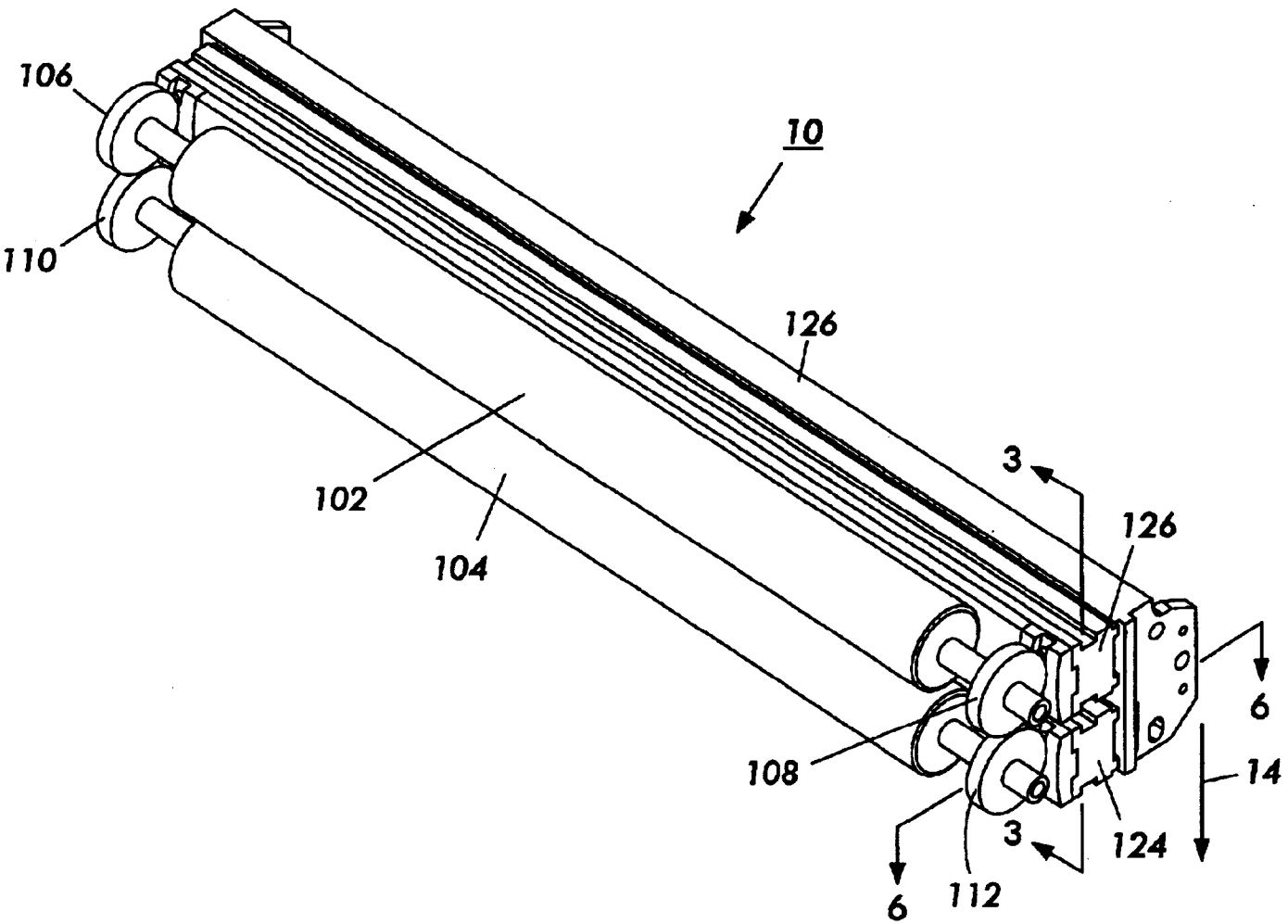
FIG. 2 is a schematic, perspective view of the donor roll portion of a developer unit and the exemplary embodiment of a backer bar assembly engaged.
Figure 3:
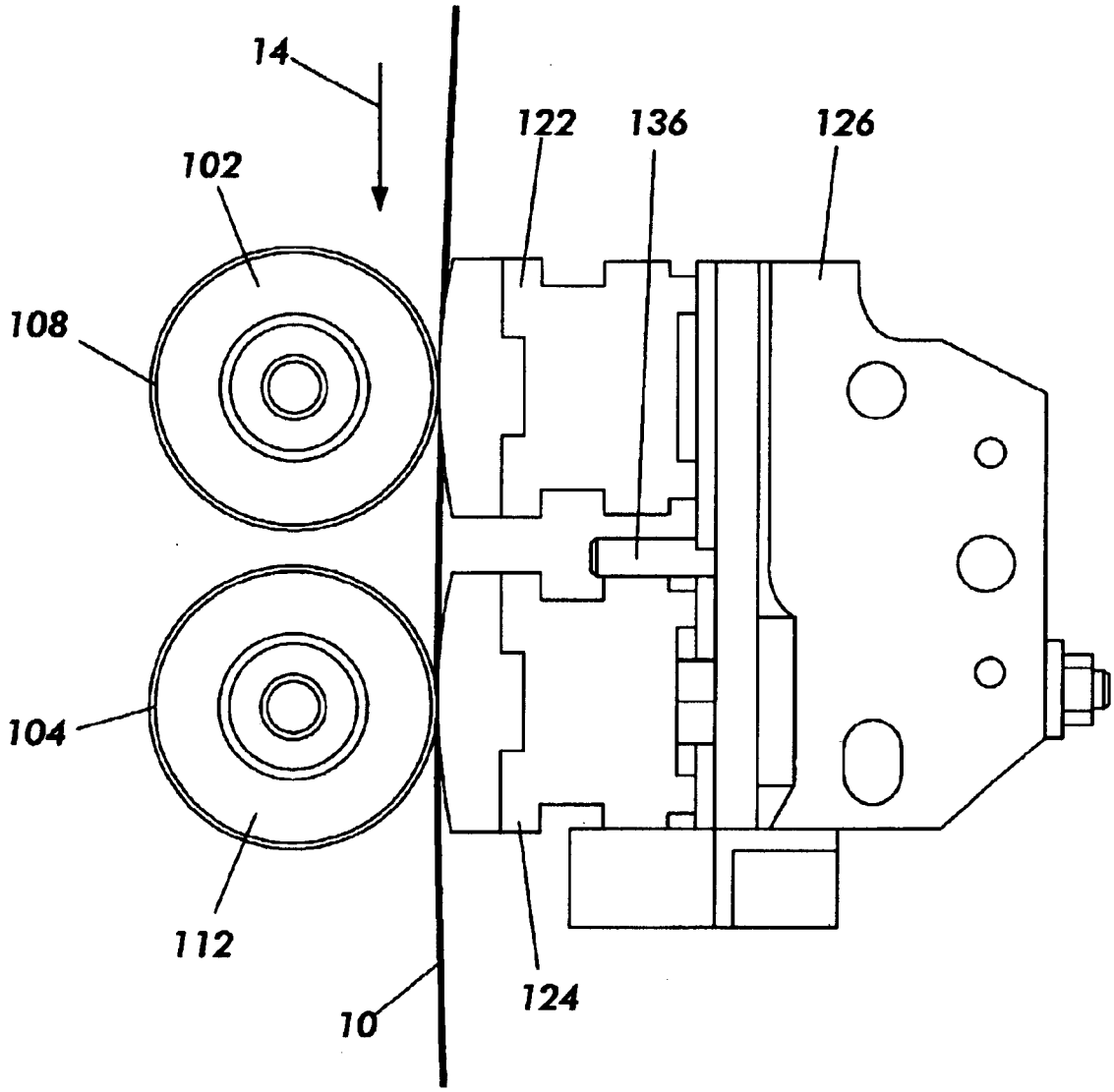
FIG. 3 is a schematic elevated right side view of a donor roll portion of a developer unit and an exemplary embodiment of a backer bar assembly engaged.

FIGS. 2–3 illustrates an enlarged illustration of the photoreceptor belt 10 passing by an exemplary developer unit. In embodiments, the developer unit includes two rolls 102, 104 which each transfer toner powder to the photoreceptor surface. In embodiments, the developer units 30, 36, 42, 48, and 54 are held rigidly in place. The donor rolls 102 and 104 are exemplary embodiments of the donor rolls that may be found in any of the developer units 30, 36, 42, 48, 54. In such embodiments, the backer bars 122, 124 bias the photoreceptor belt 10 into position near the donor rolls. Each pair of backer bars 122 and 124 are exemplary embodiments of the backer bars that may be found supporting the belt 10 at any of the developing units. In some printing devices, the developer unit is not held rigidly in place. Instead, the developer unit is biased against the photoreceptor module contacting the backer bar(s). This is a method to maintain a suitable gap between the photoreceptor belt and the developer surface.

In embodiments, each developer donor roll includes a pair of donor roll assembly bearings 106, 108, 110, 112 with one bearing located at each end of the rolls 102, 104. In embodiments, the donor rolls 102, 104 can be designed with nesting features so that each donor roll assembly bearing will slip into fixed features within the developer housing assembly. The bearings 106, 108, 110, 112 would then be clamped down with a retainer assembly. This approach fixes, into place, each donor roll assembly within the developer unit.

In embodiments, each developer unit has four fixed points that contact the photoreceptor assembly: a pair of upper donor roll bearings 106, 108 and a pair of lower donor roll bearings 110, 112. The terms "upper" and "lower" are used to denote location relative to the direction of belt travel 14. A section of belt 10 first passes the upper donor roll 102 and the upper backer bar 122 before passing the lower donor roll 104 and the lower backer bar 124. Depending on the orientation of the belt 10 and the location of a particular developer unit, the upper donor roll and the upper backer bar may be below the lower donor roll and the lower backer bar.

Figure 6:
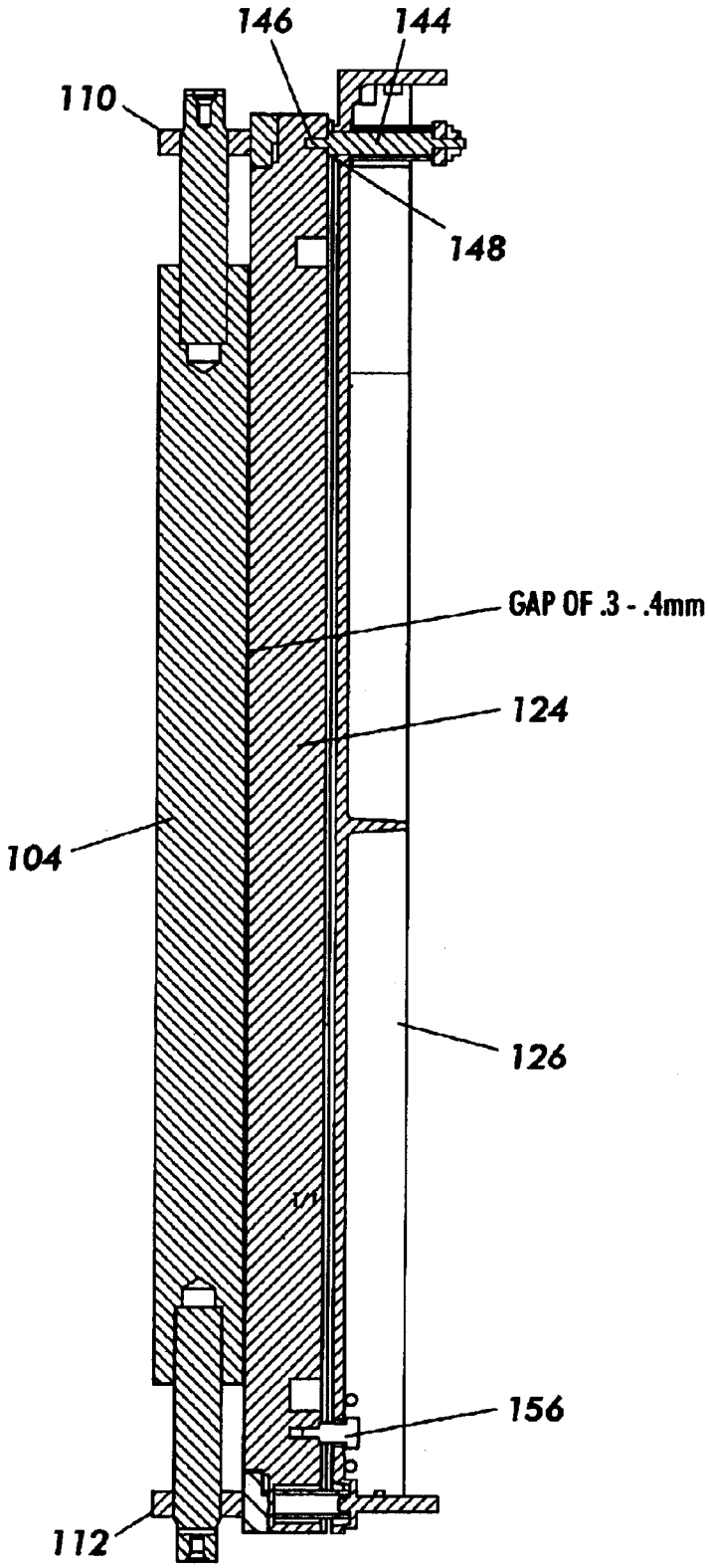
FIG. 6 is a schematic view of a cross section of a lower donor roll of a developer unit engaged with an exemplary embodiment of a lower backer bar.
Figure 7:
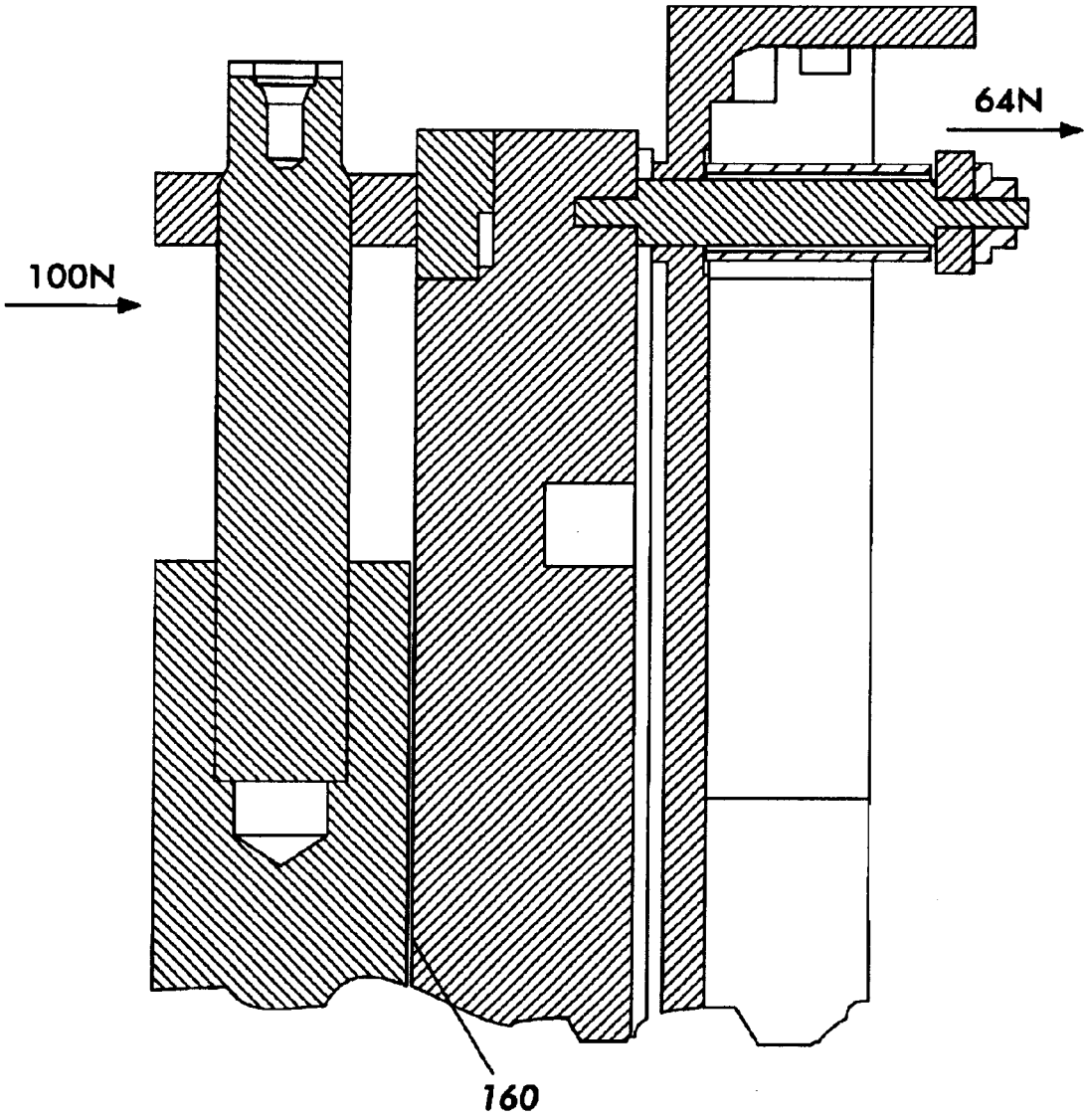
FIG. 7 is an enlarged schematic view of an inboard end of the lower donor roll of a developer unit engaged with the exemplary embodiment of a lower backer bar.
Figure 8:
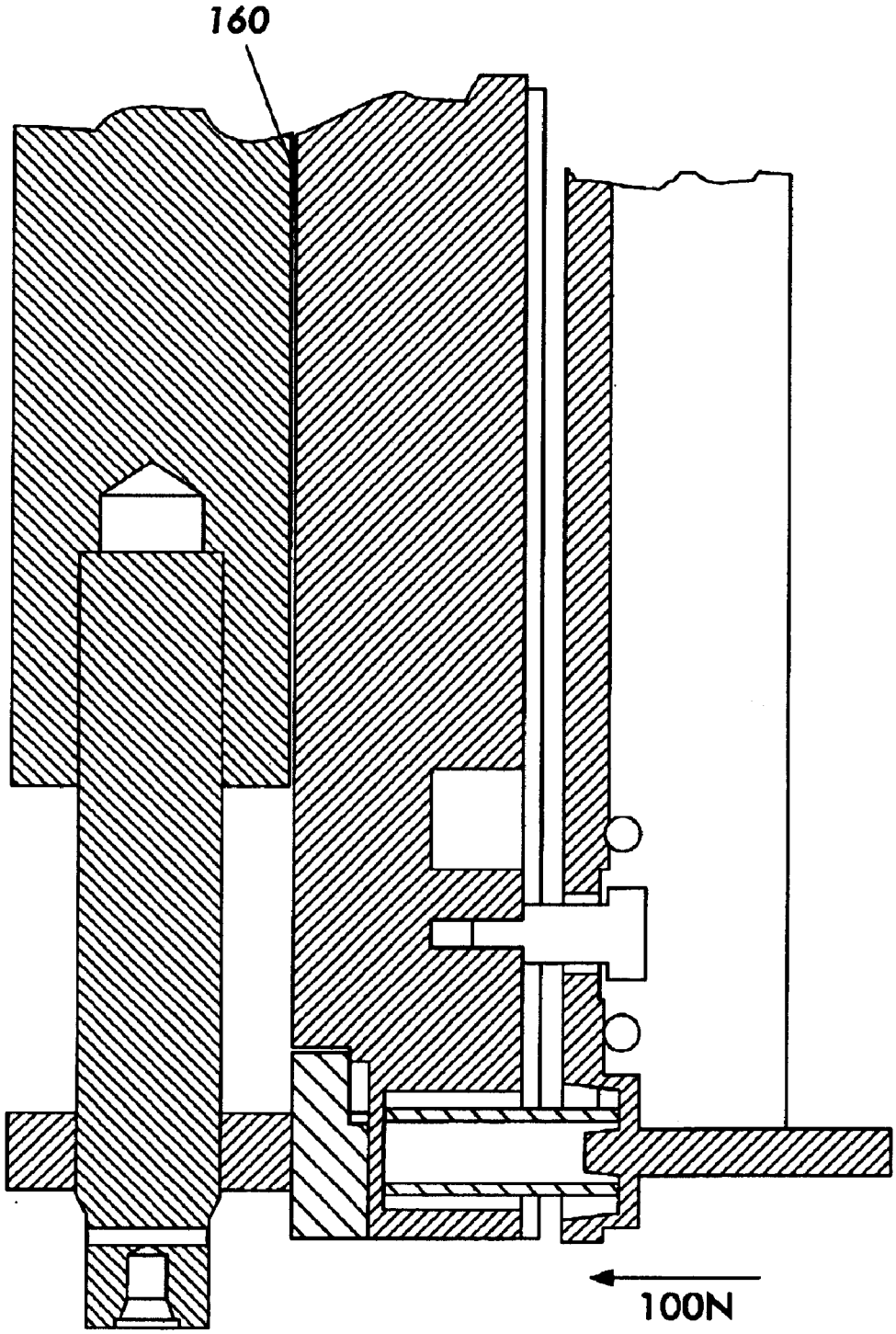
FIG. 8 is an enlarged schematic view of an outboard end of the lower donor roll of a developer unit engaged with the exemplary embodiment of a lower backer bar.

Backer bars 122, 124 bias the photoreceptor belt 10 into position proximate to the developer rolls. The donor roll bearings 106, 108, 110, 112 contact the ends of each backer bar 122, 124. This maintains a narrow gap 160 (see FIGS. 6–8) between the photoreceptor belt 10 and the surfaces of the donor rolls 102, 104. The gap needs to be large enough so that the donor rolls do not erase the toner images from previous developer units and also narrow enough so that toner will leave the donor rolls 102, 104 and adhere to the belt 10. The developer donor roll assemblies are ground and assembled such that the tolerances contributing to the gap are (1) the donor roll outside diameter, (2) the donor roll runout, (3) the donor roll bearing outside diameter, and (4) the donor roll bearing internal clearances and runout. The nominal gap is then the radial difference between the developer donor roll bearing diameter and the donor roll outside diameter minus the photoreceptor belt thickness. In embodiments, this gap is between 300 and 500 microns.

Figure 4:
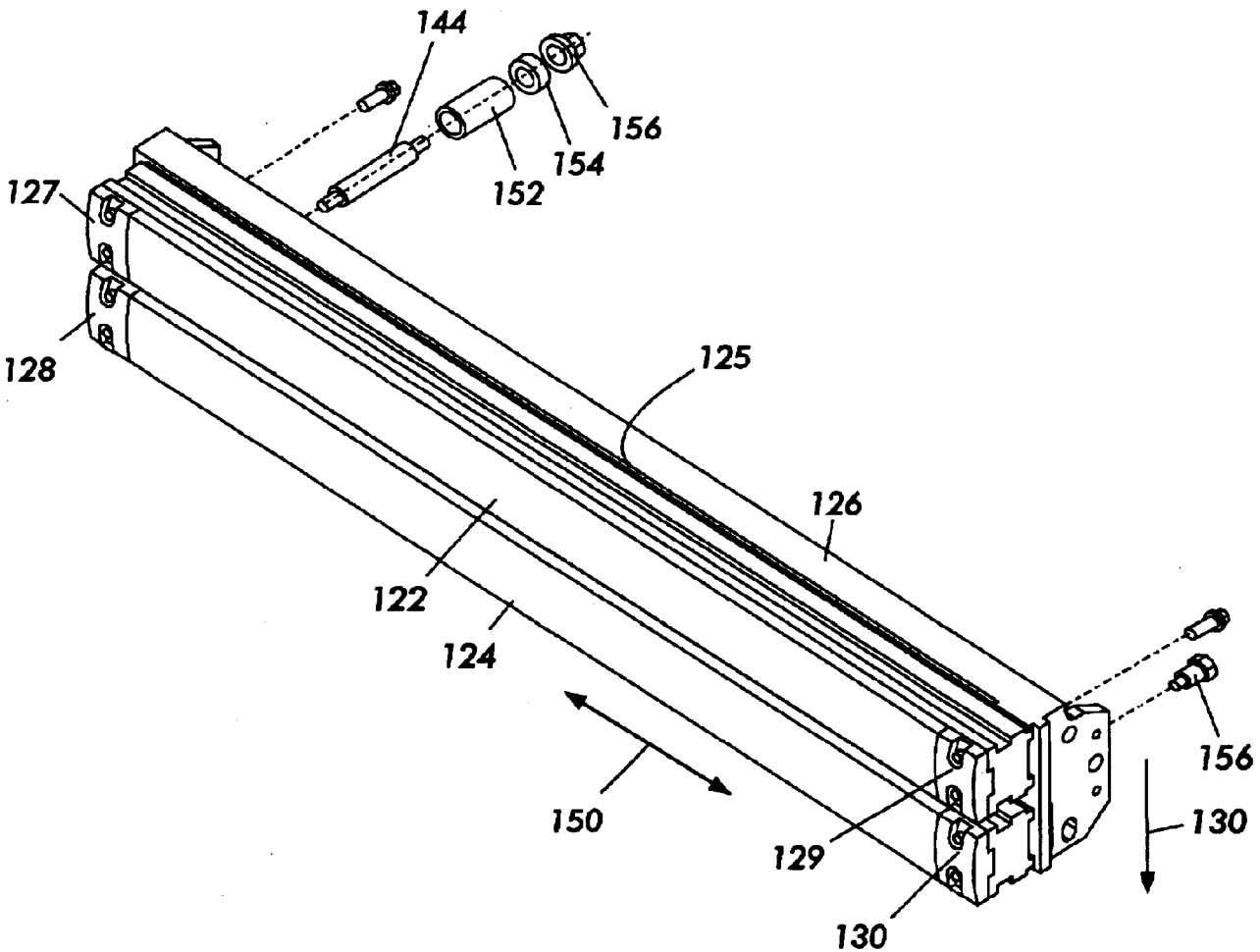
FIG. 4 is a schematic perspective view of the exemplary embodiment of a backer bar assembly.
Figure 5:
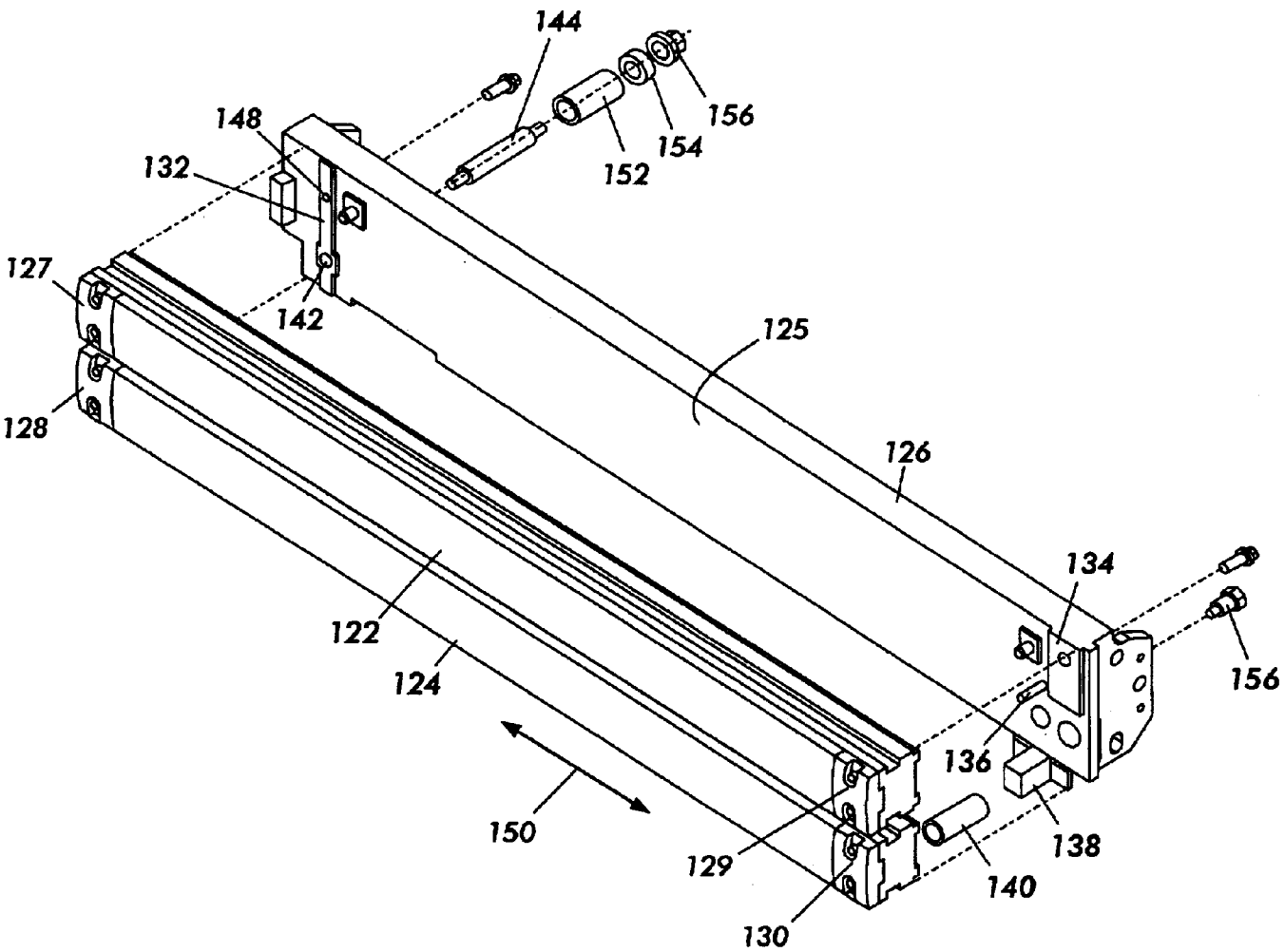
FIG. 5 is an exploded schematic perspective view of the exemplary embodiment of a backer bar assembly.

FIGS. 4–5 illustrate the backer bar assembly by itself. The developer backer bar support 126 is located by and is hard mounted to a photoreceptor module frame assembly (not shown). In embodiments, where the photoreceptor module assembly is designed to be rigid, the upper developer backer bar 122 is located by and is hard mounted to the developer backer bar support 126. An inboard (fixed) end 128 of the lower developer backer bar 124 is located by and held up against the developer backer bar support 126. However, an outboard (compliant) end 130 of the lower developer backer bar 124 has limited freedom of movement. Another way of stating the freedom of movement of the lower backer bar 124 is to say that it is compliant. The fact that the outboard end 130 of the lower bar 124 is compliant helps ensure that lower developer backer bar 124 contacts the lower outboard developer donor roll bearing 112 when a developer unit and the photoreceptor assembly are in contact. In embodiments, the lower backer bar 124 could be hard mounted, and the upper backer bar 122 could have a compliant end.

The upper backer bar 122 is rigidly secured to the backer bar support 126. In embodiments, the inboard 127 and outboard ends 129 of the upper bar 122 are connected to upper inboard 132 and upper outboard 134 mounting pads. The upper backer bar 122 is attached to the mounting pads 132, 134 in such a manner that it is prevented from moving in any direction.

The lower backer 124 is attached such that it can pivot for a short distance about the inboard end 128 of the bar. In embodiments, a dowel pin 136 pressed into the backer bar support 126 and backer bar stop 138 to substantially prevent movement of the outboard end 130 of the lower backer bar 124 back or forth in the direction of belt travel 14. However, the outboard end 130 of the lower backer bar 124 has limited freedom to move in a plane perpendicular to the direction of belt travel 14. A compression spring 140 biases the lower backer bar 124 away from the backer bar support 126. In embodiments, when the developer units and the photoreceptor assemblies are in position, the spring 140 causes the outboard end 130 to exert approximately 100N of force against the donor roll bearing 112.

The inboard end 128 of the lower backer bar 124 is fixed in place and attaches at the point about which the lower backer bar 124 pivots. In embodiments, the backer bar support 126 includes an inboard lower backer bar mounting surface 142. A shaft 144 having at least a portion that is threaded is attached to the lower backer bar 124 via a tapped hole 146 on the inboard end 128 of the lower backer bar 124. The tapped hole 146 can be seen better in the cross-sectional views of FIGS. 6–7. The shaft 144 is then slid through a relatively tight fitting hole 148 in the developer backer bar support 126. This prevents substantial movement of the lower backer bar 124 back or forth in either the direction of belt travel 14 or along the long axis 150 of the backer bar 124. Restriction of movement of the bar 124 in either of these directions helps to maintain photoreceptor belt wrap angle around the photoreceptor module backer bars 122, 124, which is important in order to maintain belt flatness. Belt flatness is important to achieving print quality specifications. An inboard spring 152 is then slid over the shaft. A washer 154 and nut 156 compress the spring 152, thereby pulling the lower backer bar 124 up against the inboard mounting surface 142 of the backer bar support 126. In embodiments, the compressed spring 152 exerts a force of approximately 64N. This force is sufficient to ensure that the lower backer bar 124 will always be held up against the mounting surface of the backer bar support 126. As the outboard end 130 of the lower backer bar 124 pivots, the inboard end 128 rocks on the inboard lower backer bar mounting surface 142 of the developer backer bar support 126. In embodiments, the mounting surface 142 is approximately 7 mm wide.

In embodiments, the inboard lower backer bar mounting surface 142 is positioned directly opposite the donor roll bearing 110. This placement reduces the bending moment that the 100N load from the developer biasing force puts into the lower backer bar 124, which assists in maintaining the donor roll to photoreceptor belt gap throughout the entire development zone.

There is just enough clearance between the hole 148 in the developer backer bar support 126 and the shaft 144 to allow the outboard end 130 of the lower backer bar 124 to pivot through a range of a few millimeters. In embodiments, a backer-stop 138 prevents the outboard end 130 from traveling too far from the backer bar support 126. As the arc length is so short, the distance traveled is effectively perpendicular to the surface 125 of the backer bar support 126. In embodiments, the available travel of the outboard end 130 is limited to approximately two millimeters.

More specifically, the backer-stop 138 limits the travel of the outboard end 130 to plus or minus approximately one millimeter from its operating position. The backer bars 122, 124 are in operating position when the developer unit is in position with the photoreceptor assembly and the donor roll bearings 106, 108, 110, 112 are in physical contact with the backer bars 122, 124. In embodiments, when the developer unit is in position, the outboard end 130 of the lower backer bar 124 is compressed by approximately one millimeter from its fully extended rest position. The spring 140 could be compressed approximately one millimeter further until the lower backer bar 124 contacts the surface 125 of the backer bar support 126, or alternatively, allowed to relax up to its extended rest position. This freedom of movement allows the outboard end 130 of the lower backer bar 124 to move and contact the developer donor roll bearing 112.

When the developer and photoreceptor assemblies are in position, the contact points of the inboard bearing 106 and the outboard bearing 108 of the upper roll 102 and the inboard bearing 110 of the lower roll 104 define a plane. In embodiments, the perpendicular distance between the contact point of the outboard bearing 112 of the lower donor roll 104 and the plane is approximately ±0.1 mm. This distance defines the required travel of the outboard end 130 of the lower backer bar 124. The difference between the available travel and the required travel helps ensure that the outboard end 130 of the lower backer bar 124 will contact the donor roll bearing 112. The compressibility range allows the lower backer bar 124 to contact the developer backer bar support 126 without binding up.

With the developer unit in it's operating position, it is biased against the photoreceptor assembly with a total force of approximately 400N. 100N at each contact point. With the developer being rigid and biased up against the three photoreceptor assembly fixed points, the attitude of the developer is set relative to the photoreceptor assembly and photoreceptor belt 10. With the attitude of the developer set, the lower outboard donor roll bearing 112 sets the position of the lower outboard backer bar end 130. This is the fourth contact point between the developer unit and the photoreceptor assembly. The force that the lower developer backer bar 124 exerts against the lower outboard donor roll bearing 112 is approximately 100N.

While the present invention has been described with reference to specific embodiments thereof, it will be understood that it is not intended to limit the invention to these embodiments. It is intended to encompass alternatives, modifications, and equivalents, including substantial equivalents, similar equivalents, and the like, as may be included within the spirit and scope of the invention.

What is claimed:

1. A backer bar assembly for supporting a photoreceptor belt, comprising:

a first developer backer bar having first and second ends;

a second developer backer bar having first and second ends, wherein the first and second ends of the first backer bar are substantially fixed, wherein the first end of the second developer backer bar is substantially fixed, and wherein the second end of the second developer backer bar can travel within a limited range in response to an externally applied force.

2. The backer bar assembly of claim 1, further comprising a backer bar support to which the first backer bar and the second backer bar are attached.

3. The backer bar assembly of claim 1, wherein the range of travel of the second end of the second developer backer bar is approximately 2 mm.

4. The backer bar assembly of claim 1, wherein the second developer backer bar pivots about the first end of the second developer backer bar.

5. The backer bar assembly of claim 1, wherein the backer bar assembly and a donor member assembly are biased against each other.

6. The backer bar assembly of claim 5, wherein the backer bar assembly and the donor roll assembly are biased against each other with approximately 400 N of force.

7. The backer bar assembly of claim 5, wherein the first backer bar is located adjacent to and in substantially axial alignment with a first developer donor member of the donor member assembly, and wherein the second backer bar is located adjacent to and in substantially axial alignment with a second developer donor member of the donor member assembly.

8. The backer bar assembly of claim 7, wherein first and second donor member bearings on the first developer donor member are biased against the first and second ends of the first developer backer bar, and wherein first and second donor member bearings on the second developer donor member are biased against the first and second ends of the second developer backer bar.

9. The backer bar assembly of claim 8, wherein the first donor member bearing of the first developer donor member is biased against the first end of the first developer backer bar with approximately 100 N of force, wherein the second donor member bearing of the first developer donor member is biased against the second end of the first developer backer bar with 100 N of force, wherein the first donor member bearing on the second developer donor member is biased against the first end of the second developer backer bar with 100 N of force, and wherein the second donor member bearing on the second developer donor member is biased against the second end of the second developer backer bar with 100 N of force.

10. An electrophotographic printing device, comprising:

an image recording station including a charging device and an exposure device;

a developer unit having a first donor roll, a second donor roll, a substantially rigid first backer bar having first and second ends, a second developer backer bar having first and second ends, wherein the first and second ends of the first backer bar are substantially fixed, wherein the first end of the second developer backer bar is substantially fixed, and wherein the second end of the second developer backer bar can travel within a limited range in response to an externally applied force;

a transfer station; and a fusing station.

11. The printing device of claim 10, further comprising a backer bar support to which the first backer bar and the second backer bar are attached.

12. The printing device of claim 10, wherein the first backer bar is located adjacent to and in substantially axial alignment with the first donor roll, and wherein the second backer bar is located adjacent to and in substantially axial alignment with the second donor roll.

13. The printing device of claim 10, wherein the first donor roll has first and second donor roll bearings and the second donor roll has third and fourth donor roll bearings.

14. The printing device of claim 13, wherein the first and second donor roll bearings are biased against the first and second ends of the first backer bar, and wherein the third and fourth donor roll bearings are biased against the first and second ends of the second backer bar.

15. The printing device of claim 13, wherein the donor roll bearings have a diameter greater than a diameter of the donor roll.

16. A developing station in a printing device, comprising:

a developer having a first donor roll that includes first and second donor roll bearings, and a second donor roll having third and fourth donor roll bearings; and a photoreceptor module including a developer backer assembly for supporting a photoreceptor belt, the backer assembly having upper and lower developer backing members, wherein the upper developer backing member rigidly contacts the first and second donor roll bearings, wherein the lower developer backing member rigidly contacts the third bearing at a first point, and wherein the lower developer backing member compliantly contacts the fourth bearing.

17. The developing station of claim 16, further comprising a backer bar support to which the first backer bar and the second backer bar are attached.

18. The developing station of claim 16, wherein the upper developer backing member is located adjacent to and in substantially axial alignment with the first donor roll, and wherein the lower developer backing member is located adjacent to and in substantially axial alignment with the second donor roll.

19. The developing station of claim 16, wherein the upper and lower backer members are biased against the first and second donor rolls respectively.

20. The developing station of claim 16, wherein the donor roll bearings have a diameter greater than a diameter of the donor roll.

* * * * *